US008787805B2

(12) United States Patent
Nakajima

(10) Patent No.: US 8,787,805 B2
(45) Date of Patent: Jul. 22, 2014

(54) IMAGE FORMING APPARATUS HAVING AN INTERMEDIATE TRANSFER BELT

(75) Inventor: Takao Nakajima, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 101 days.

(21) Appl. No.: 13/371,261

(22) Filed: Feb. 10, 2012

(65) Prior Publication Data

US 2012/0207522 A1 Aug. 16, 2012

(30) Foreign Application Priority Data

Feb. 15, 2011 (JP) ..... 2011-029972

(51) Int. Cl.
*G03G 15/20* (2006.01)

(52) U.S. Cl.
USPC ..... 399/308

(58) Field of Classification Search
USPC ..... 399/388, 308, 316, 124
See application file for complete search history.

(56) References Cited

FOREIGN PATENT DOCUMENTS

| | | | | |
|---|---|---|---|---|
| JP | 2000-293066 | A | | 10/2000 |
| JP | 2006-089232 | A | | 4/2006 |
| JP | 2006139168 | A | * | 6/2006 |

* cited by examiner

*Primary Examiner* — Clayton E LaBalle
*Assistant Examiner* — Victor Verbitsky
(74) *Attorney, Agent, or Firm* — Canon USA Inc IP Division

(57) ABSTRACT

An area in which a sheet member and an intermediate transfer belt are in contact with each other is provided between an intersection between a guide surface of the second guide portion configured to guide a recording material toward the intermediate transfer belt and the intermediate transfer belt and a nip portion.

7 Claims, 2 Drawing Sheets

IMAGE FORMING APPARATUS HAVING AN INTERMEDIATE TRANSFER BELT

BACKGROUND

1. Field of the Invention

The present disclosure relates to an image forming apparatus such as copying machines, printers, and facsimile apparatuses configured to form a toner image on a recording material using an electrophotographic system or an electrostatic recording system. More specifically, the disclosure relates to an image forming apparatus having an intermediate transfer belt configured to carry a toner image to be transferred to a recording material.

2. Description of the Related Art

Examples of image forming apparatuses of the related art include a configuration in which a toner image formed on a photosensitive drum as an image carrier is transferred to a recording material at a transfer nip portion.

At the time of conveying the high-rigidity recording material such as a thick paper, when a trailing end of the recording material leaves a covey roller or a leading end of the recording material enters the transfer nip portion, the posture of the recording material is changed and hence the trailing end of the recording material is flipped upward. When the leading end of the recording material is at the transfer nip portion, the recording material vibrates due to a shock imparted by a contact to other portions of the trailing end of the recording material caused by the change of the posture of the recording material, which may cause a transfer failure. In order to reduce the shock, a configuration in which a shock absorbing plate formed of a plate member having a resiliency and rigidity such as a synthetic resin is arranged on a lower surface of a pre-transfer upper guide so as not to come into contact with the pre-transfer lower guide is exemplified (Japanese Patent Laid-Open No. 2006-089232). In this configuration, when the high-rigidity recording material such as a post card is passed through, the shock absorbing plate is resiliently curved upward along the flip-up of the recording material when the shock absorbing plate leaves the transfer roller, so that the impact imparted on a transfer portion may be alleviated.

Examples of the image forming apparatuses in recent years include a configuration in which a toner image formed on a photosensitive drum, which is an image carrier, is transferred from the photosensitive drum to an intermediate transfer belt, and the toner image is transferred from the intermediate transfer belt to the recording material to form the toner image on the recording material.

Then, in the configuration in which the intermediate transfer belt is used, the leading end of the recording material is likely to come into contact with the intermediate transfer belt. When the leading end of the recording material comes into contact with the intermediate transfer belt, there is a case where an impact is propagated to the transfer nip portion and then to an image forming portion via the intermediate belt, thereby generating defective images.

In order to prevent such a phenomenon, a configuration in which the shock absorbing plate as described above is used and a distal end of the shock absorbing plate is brought near to the transfer nip portion to avoid easy contact of the recording material to the intermediate transfer belt. However, depending on the distance between the distal end of the shock absorbing plate and the transfer nip portion, the shock absorbing plate and the intermediate transfer belt are likely to come into contact with each other due to vibrations of a surface of the intermediate transfer belt during rotation, and the image on the intermediate transfer belt is likely to be distorted. Therefore, even when the leading end of the recording material and the intermediate transfer belt come into contact with each other, countermeasures for the intermediate transfer belt to reduce the shock applied by the recording material are needed.

SUMMARY OF THE INVENTION

The disclosure provides an image forming apparatus configured in such a manner that even when a recording material comes into contact with an intermediate transfer belt, a shock imparted to the intermediate transfer belt caused by contact can be reduced.

The disclosure also provides an image forming apparatus including an intermediate transfer belt; an image forming unit configured to form a toner image on the intermediate transfer belt; a transfer inner roller provided on an inner surface of the intermediate transfers belt and configured to form a nip portion that transfer the toner image formed on the intermediate transfer belt onto a recording material; a transfer outer roller configured to press an outer surface of the intermediate transfer belt and configured to form the nip portion; a first guide portion provided to oppose the intermediate transfer belt for guiding the recording material to the nip portion; a second guide portion provided to oppose the first guide portion for guiding the recording material to the nip portion by coming into contact with a surface of the recording material opposite from the surface on the side of the intermediate transfer belt; and a sheet member configured to urge the intermediate transfer belt from the inner surface and provided between an intersection between a guide surface of the second guide portion configured to guide the recording material toward the intermediate transfer belt and the intermediate transfer belt and the nip portion.

Further features will become apparent from the following description of exemplary embodiments with reference to the attached drawings.

DESCRIPTION OF THE EMBODIMENTS

Embodiment

Image Forming Apparatus

Figure 1:
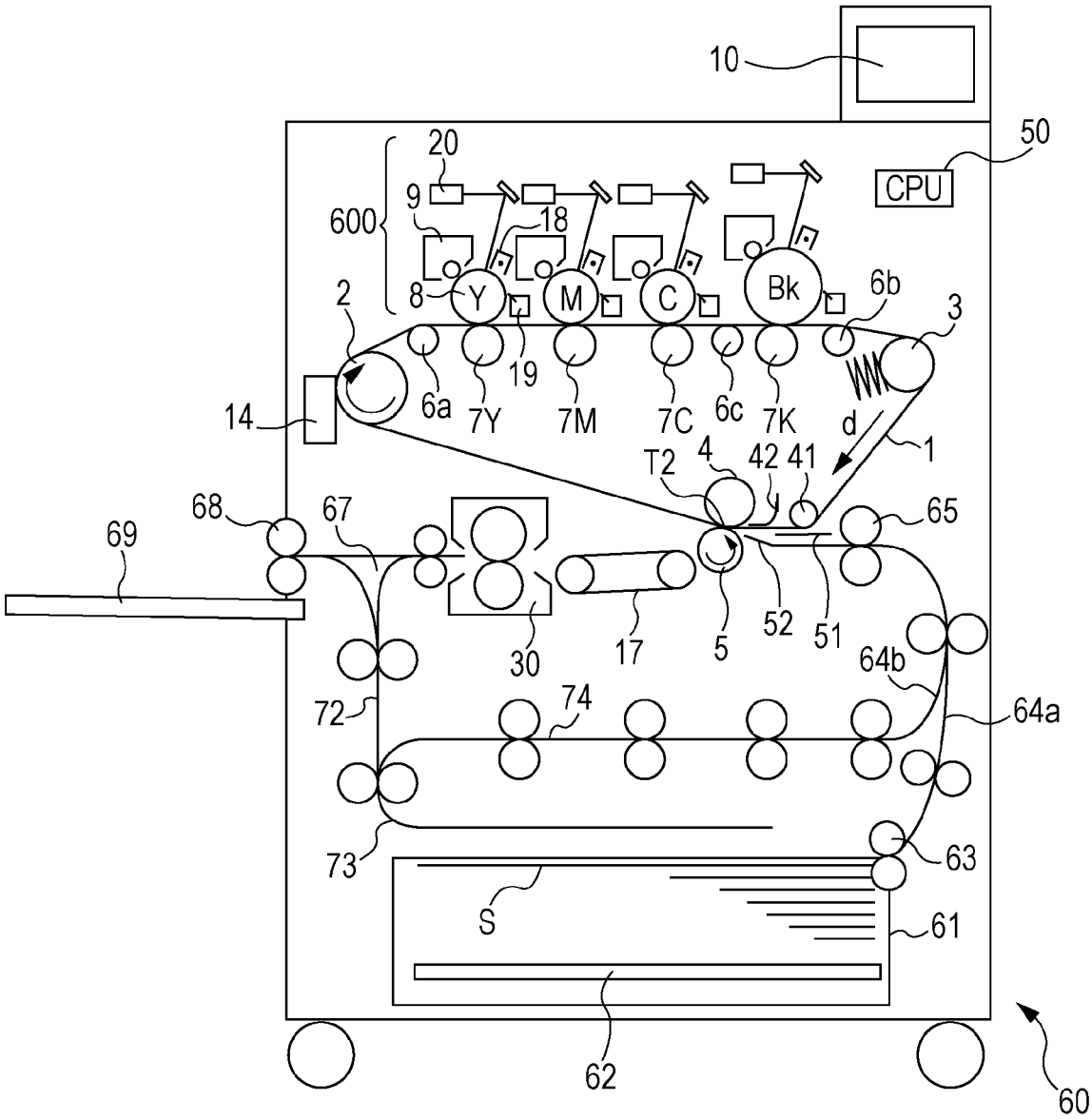
FIG. 1 is an explanatory cross-sectional view showing an operation of a color image forming apparatus.

An image forming apparatus according to an embodiment of the disclosure will be described. FIG. 1 is a cross-sectional view of a color image forming apparatus using an electrographic system. An image forming apparatus 60 includes image forming portions configured to form images using toner of four different colors, respectively, arranged side by side so as to oppose an intermediate transfer belt 1.

Process of Conveying Recording Material

First of all, a process of conveying recording materials in an image forming apparatus shown in FIG. 1 will be described. Recording materials S are accommodated in a state of being stuck in a lift up apparatus 62 in a recording material storage 61, and are supplied by a paper feeder 63 at timing preset so as to coincide with image forming timing. Here, the paper feeder 63 in this embodiment employs a system using a frictional separation using a paper supply roller or the like. The recording material S supplied by the paper feeder 63 passes through a conveying path 64*a* and is conveyed to a pair of registration rollers 65. After having performed skew correction and timing correction at the pair of registration rollers 65, the recording material S is fed to a secondary transfer portion T2. The secondary transfer portion T2 is a transfer nip portion formed by a secondary transfer inner roller 4 and a secondary transfer outer roller 5, and is configured to transfer the image from the intermediate transfer belt 1 onto the recording material S by applying a predetermined pressing force and an electrostatic load bias. The secondary transfer inner roller 4 is a roller coming into contact with an inner surface of the intermediate transfer belt 1, and giving a tension to the intermediate transfer belt 1. The secondary transfer outer roller 5 is a roller configured to press an outer surface of the intermediate transfer belt 1.

Process of Forming Image

In contrast to the process of conveying the recording material S to the secondary transfer portion T2 described thus far, a process of forming an image of the toner image fed to the secondary transfer portion at similar timing will be described. An image forming portion 600 includes an image forming portion Y using yellow toner, an image forming portion M using magenta toner, an image forming portion C using cyan toner, and an image forming portion BK using black toner. In this embodiment, since the processes of forming an image in the image forming portions Y to BK are the same, the image forming portion Y will be described as a representative. The image forming portion Y includes a photosensitive drum 8, which is an image carrier, a charging apparatus 18, an exposure apparatus 20, a developing apparatus 9, a primary transfer apparatus 7, and a photosensitive member cleaner 19. The surface of the photosensitive drum 8 is charged evenly by the charging apparatus 18, and an electrostatic latent image is formed by the exposure apparatus 20 on the basis of a signal of supplied image information. Subsequently, the electrostatic latent image formed on the photosensitive drum 8 is developed by the developing apparatus 9, so that a toner image is formed on the photosensitive drum 8. Then, a predetermined pressing force and an electrostatic load bias are applied by the primary transfer apparatus 7, and the toner image is transferred to the intermediate transfer belt 1. Finally, remaining toner remaining on the photosensitive drum 8 by being not transferred to the intermediate transfer belt 1 is collected by the photosensitive member cleaner 19 to be ready again for a next process of forming an image. The process of forming an image is performed in the image forming portions Y to BK, respectively, and a toner image formed in the respective image forming portions are superimposed with each other on the intermediate transfer belt 1, whereby a color toner image is formed.

Subsequently, the intermediate transfer belt 1 will be described. The intermediate transfer belt 1 is an endless belt entrained about a driving roller 2, a tension roller 3, the secondary transfer inner roller 4, a secondary transfer upstream roller 41, and driven rollers 6*a* to 6*c*, and is driven to convey the images in the direction indicated by an arrow d in the drawing. The processes of forming images in respective colors performed by the image forming portions 600 of Y, M, C, and BK in parallel are performed at timing of superimposing toner images with the toner image of a color on the upstream side primarily transferred to the intermediate transfer belt 1 in sequence. Consequently, a full-color toner image is finally formed on the intermediate transfer belt 1, and is conveyed to the secondary transfer portion T2. The remaining toner after having passed through the secondary transfer portion T2 is collected by a transfer cleaner apparatus 14.

Process after Secondary Transfer

Through the process of conveying the recording material and the process of forming the image described respectively thus far, secondary transfer of the full-color toner image onto the recording material S is performed at the secondary transfer portion. Subsequently, the recording material S is conveyed to a fixing apparatus 30 by a pre-fixing conveying unit 17. The fixing apparatus 30 is configured to apply predetermined pressure and calorific power to the recording material S being passed therethrough in a fixing nip formed by opposed rollers and fix the toner image on the recording material S. The fixing apparatus 30 is provided with a heater as a heat source, and power distribution to the heater is controlled so that a predetermined image heating temperature is maintained. The recording material S having passed through the fixing apparatus 30 is subject to a route selection whether it is discharged onto a paper output tray 69 from an eject roller 68 as is by a branching conveying apparatus 67 or is conveyed to a reverse conveying apparatus 72 when duplex image formation is required. When the duplex image formation is required, the recording material S fed to the reverse conveying apparatus 72 is inverted in the switch back conveying path 73 so that a leading end is replaced by a trailing end of the recording material S, and is conveyed to a duplex conveying path 74. Subsequently, being timed nicely with a recording material conveyed from the paper feeder 63 for a trailing job, the recording material S is merged from a paper refeeding path 64*b* and is fed again to the secondary transfer portion T2. The process of forming an image on the back side is the same as the case for the front surface described above, and hence description thereof is omitted.

Configuration of Secondary Transfer Portion

Figure 2:
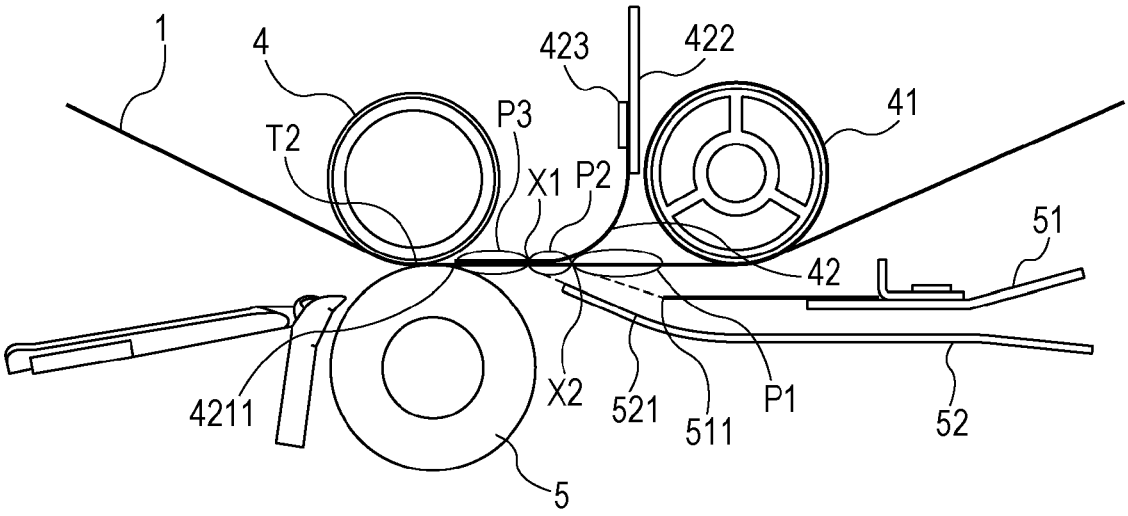
FIG. 2 is a front view of an embodiment.

Subsequently, a configuration of a portion in the vicinity of the secondary transfer portion T2, which is characteristic configuration of this embodiment, will be described using FIG. 2.

In this embodiment, the secondary transfer portion T2 is formed by the secondary transfer inner roller 4 and the secondary transfer outer roller 5. The secondary transfer inner roller 4 has a configuration including a resilient layer having a thickness of 1 mm on a surface of a hollow metallic roller. The secondary transfer outer roller has a configuration including a resilient layer having a thickness of 5 mm on a core bar of a solid metal. Then, the secondary transfer upstream roller (tension roller) 41 for stabilizing the tension of the intermediate transfer belt in an area where the recording material and the intermediate transfer belt 1 come into contact with each other in a state of being high is provided on the upstream side of the secondary transfer portion T2 in the direction of rotation of the intermediate transfer belt 1. In this embodiment, the distance between the secondary transfer portion T2 and the secondary transfer upstream roller 41 is set to be 30 mm.

In addition, in this embodiment, a sheet member 42 configured to urge the intermediate transfer belt 1 from the inside is provided in order to increase the tension of the intermediate transfer belt between the secondary transfer inner roller 4 and the secondary transfer upstream roller 41.

The width in the direction of the width (the direction orthogonal to the direction of conveyance of the recording material) of the sheet member 42 is larger than the width of the recording material of a maximum allowable size of the image forming apparatus. Then, the sheet member 42 is supported by being nipped between a sheet mounting plate 422 and a sheet fixing plate 423, and is fixed to an intermediate transfer belt frame. The sheet member 42 is a sheet material formed of polyethylene terephthalate or polyethylene, and has a thickness on the order of 100 μm.

The recording material S is arranged so as to satisfy a relationship; L1<L2, where L1 is the distance from a sheet member distal end 4211 in the direction of conveyance of the recording material to the secondary transfer portion T2 (see FIG. 2), and L2 is the length of a margin at the leading end of the recording material in the direction of conveyance which is located on the leading end side with respect to an image area formed on the recording material. Here, the secondary transfer portion T2 is an area pressed by the secondary transfer inner roller 4 and the secondary transfer outer roller 5. When a surface on which the image is to be formed on the downstream side with respect to the leading end of the recording material is pressed against the intermediated transfer belt immediately after the leading end of the recording material enters the second transfer portion, generation of streaks of uneven transfer in the width direction so as to extend along the shape of the distal end of the sheet member can be inhibited.

In this embodiment, by using the sheet member, a tension can be applied to the intermediate transfer belt in a large area in the direction of rotation of the intermediate transfer belt. Consequently, a belt surface of the intermediate transfer belt in an upstream area with respect to the secondary transfer portion T can be stabilized in the direction of rotation of the intermediate transfer belt.

Subsequently, relationship of an upper entry guide 51 provided on the side of a surface of the conveyed recording material on the side of the intermediate transfer belt 1 for guiding the recording material to the secondary transfer portion T and a lower entry guide 52 provided to oppose the upper entry guide 51 for guiding the recording material to the secondary transfer portion T by coming into contact with the surface of the recording material on the side opposite from the surface in which the image is transferred with respect to an urging area of the sheet member will be described.

The lower entry guide 52 includes a lower entry guide straight area 521, which is a guiding surface for guiding the recording material toward the intermediate transfer belt. In other words, the guiding surface defines the direction of conveyance of the recording material, and is a partial straight area extending from a distal end of, or from a portion in the vicinity of the distal end of the lower entry guide toward the downstream side in the direction of conveyance of the recording material.

In contrast, the areas in which the sheet member 42 and the intermediate transfer belt 1 are in contact are defined as P2 and P3. In other words, the area closer to a bent portion of the sheet member is defined as P2, and the area on the downstream side with respect to the area P2 in the direction of rotation of the intermediate transfer belt is defined as P3. Also, the area on the upstream side with respect to the area P2 in the direction of rotation of the intermediate transfer belt and on the downstream side with respect to the secondary transfer upstream roller 41 is defined as an area P1. The degree of tension of the belt between the secondary transfer portion T2 and the secondary transfer upstream roller 41 satisfies a relationship; P2 P3≥P1. In other words, the rigidity of the area P2 is the highest.

Therefore, in this embodiment, the lower entry guide and the upper entry guide are set so that the leading end of the high-rigidity recording material comes into abutment with the area P2 in order to alleviate the shock imparted by the high-rigidity recording materials coming into contact with the intermediate transfer belt 1. In this embodiment, the high-rigidity recording material means the recording material having a basis weight of 156 g/m$^2$ or more. In other words, since the high-rigidity recording material can hardly be deformed, the setting of the direction of conveyance of the high-rigidity recording material at the entry guide is dominant. In this embodiment, the upper entry guide and the lower entry guide are set in such a manner that a contact starting portion where the sheet member and the intermediate transfer belt start to come into contact comes to an area interposed between an intersection X1 between an extended surface of the guide surface of the lower entry guide and the intermediate transfer belt and an intersection X2 between a parallel surface passing through a distal end of the upper entry guide extending in parallel to the guiding surface and the intermediate transfer belt. Consequently, the high-rigidity recording material comes into contact with an area having a high tension, so that generation of vibrations can be reduced. In order to cause the leading end of the recording material to come into abutment with a position closer to the contact starting portion, a distal end portion 511 of the upper entry guide is preferably arranged between the contact starting portion and the secondary transfer upstream roller 41 in the direction of movement of the intermediate transfer belt 1. As described thus far, even when the recording material comes into contact with the intermediate transfer belt, the shock imparted by contact can be made to be propagated hardly to the transfer portion.

Although the embodiment of the disclosure has been described thus far, the disclosure is not specifically limited to the embodiment described above, and various modifications are possible within the technical thought of the disclosure.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2011-029972 filed Feb. 15, 2011, which is hereby incorporated by reference herein in its entirety.

What is claimed is:

1. An image forming apparatus comprising:

an intermediate transfer belt;

an image forming unit configured to form a toner image on the intermediate transfer belt;

a transfer inner roller provided on an inner surface of the intermediate transfer belt and configured to form a nip portion that transfer the toner image formed on the intermediate transfer belt onto a recording material;

a transfer outer roller configured to press an outer surface of the intermediate transfer belt at a position opposed to the transfer inner roller and configured to form the nip portion;

a first guide member provided to oppose the intermediate transfer belt and configured to guide the recording material to the nip portion;

a second guide member provided opposed to the first guide member guiding the recording material to the nip portion while the second guide member is in contact with a surface of the recording material opposite to a surface to which the toner image is to be transferred; and a sheet member configured to urge the intermediate transfer belt in a region between a crossing portion where a virtual extension line extending from a surface of the second guide member intersects the intermediate transfer belt and the upstream side of the nip portion in the conveying direction of the recording material on a cross section perpendicular to a rotation axis of the transfer inner roller.

2. The image forming apparatus according to claim 1, wherein, when the crossing portion is a first crossing portion, and on the cross section perpendicular to the rotation axis of the transfer inner roller, a crossing portion where a virtual line which is parallel to the virtual extension line passing an edge on a most downstream side of the first guide member in the conveying direction of the recording material intersects the intermediate transfer belt is a second crossing portion, a contact start point that is a point on a most upstream side of a region where the sheet member comes into contact with the intermediate transfer belt in the conveying direction of the recording material is positioned between the first crossing portion and the second crossing portion.

3. The image forming apparatus according to claim 1, wherein the sheet member is formed of a material with flexibility.

4. The image forming apparatus according to claim 1, wherein the sheet member is formed of resin.

5. The image forming apparatus according to claim 1, wherein the sheet member is fixed by a supporting member configured to support a sheet.

6. The image forming apparatus according to claim 1, wherein a length of the sheet member is longer than that of a recording material of a largest size in a direction perpendicular to the conveying direction of the recording material.

7. The image forming apparatus according to claim 1, wherein a tension roller configured to apply tension to the intermediate transfer belt is disposed adjacent to the nip portion and on an upstream side of the nip portion in a moving direction of the intermediate transfer belt, and the sheet member is disposed between the transfer inner roller and the tension roller.

* * * * *